US011193723B2

(12) United States Patent
Shi

(10) Patent No.: US 11,193,723 B2
(45) Date of Patent: Dec. 7, 2021

(54) MAIN HEADER FOR INTERNAL COMBUSTION ENGINE RADIATOR

(71) Applicant: FINCOOL TECH LLC, Staford, TX (US)

(72) Inventor: Jing Shi, Stafford, TX (US)

(73) Assignee: MSX Consulting LLC, Stafford, TX (US)

( * ) Notice: Subject to any disclaimer, the term of this patent is extended or adjusted under 35 U.S.C. 154(b) by 0 days.

(21) Appl. No.: 16/914,856

(22) Filed: Jun. 29, 2020

(65) Prior Publication Data

US 2021/0172687 A1 Jun. 10, 2021

Related U.S. Application Data

(62) Division of application No. 16/708,864, filed on Dec. 10, 2019, now Pat. No. 10,697,715.

(51) Int. Cl.

| | |
|---|---|
| ***F28F 9/02*** | (2006.01) |
| ***F28F 9/16*** | (2006.01) |
| ***F01P 3/18*** | (2006.01) |

(52) U.S. Cl.
CPC ..... *F28F 9/0221* (2013.01); *F01P 3/18* (2013.01); *F28F 9/165* (2013.01); *F01P 2070/52* (2013.01)

(58) Field of Classification Search
CPC ..... F28F 9/165; F28F 2225/08
See application file for complete search history.

(56) References Cited

U.S. PATENT DOCUMENTS

2010/0031507 A1* 2/2010 Shah ..... F28F 9/0224 29/890.052
2018/0306527 A1* 10/2018 Okubo ..... F28F 9/12

* cited by examiner

*Primary Examiner* — Elizabeth J Martin
(74) *Attorney, Agent, or Firm* — NZ Carr Law Office, PLLC

(57) ABSTRACT

A main header for an internal combustion engine radiator has cut-outs and V-shaped notches provided at the four corners of the main header. The cut-outs and V-shaped notches release the stresses after the main header is flanged, thereby ensuring the flatness or straightness of the main header. The main header further includes one or more strengthening strips disposed along the length sides and the width sides of the main header, and optionally at the region adjacent to the cut-outs, to further enhance the flatness of the main header.

6 Claims, 9 Drawing Sheets

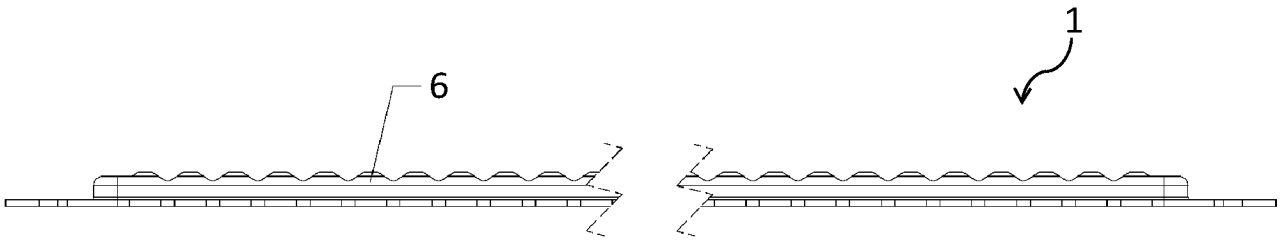
FIG. 4A
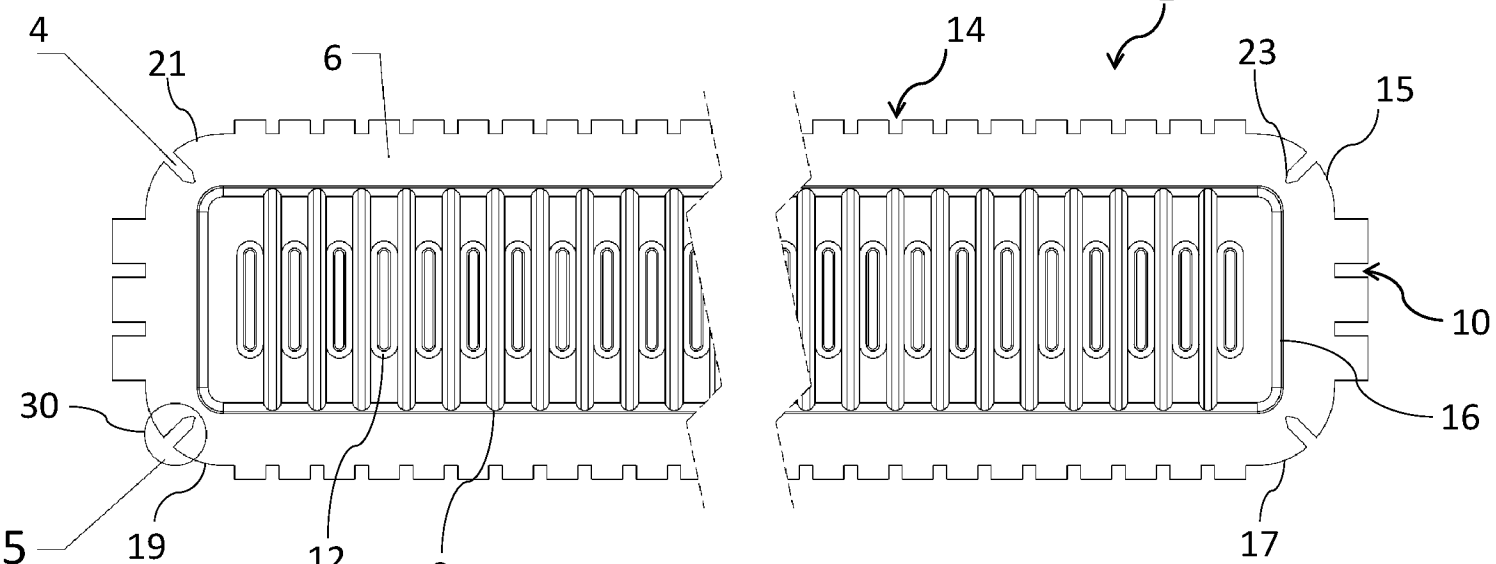
FIG. 4B
FIG. 5

MAIN HEADER FOR INTERNAL COMBUSTION ENGINE RADIATOR

BACKGROUND

Field

Implementations of the present disclosure generally relate to a main header of an internal combustion engine radiator.

Description of the Related Art

A radiator is an important component in a cooling system of an internal combustion engine. Poor cooling and leakage will directly affect the service life of an internal combustion engine, and the failure of cylinder expansion might even occur. A main header is a part connecting a radiator water chamber and a core; and its design structure and manufacturing accuracy directly affect the assembly accuracy and sealing performance of the radiator.

The conventional main header has a closed half cavity that is typically formed by bending the edges of a sheet metal to about 90°. Such bending often introduces stresses at the four corners of the main header. Since the stresses cannot be released, the main header is easily deformed after the subsequent brazing process, leading to a poor flatness of the main header and thus seal leakage due to poor compression of a seal ring.

Therefore, a need exists for an improved main header for the internal combustion engine radiator.

SUMMARY

Implementations of the present disclosure generally relate to. In one embodiment, a main header for an internal combustion engine radiator is provided. The main header includes a quadrilateral body having length sides and width sides joined together by a rounded corner, a flange extended around and upwardly from an outer periphery of the quadrilateral body, a cut-out formed in the flange at rounded corners of the quadrilateral body, a notch disposed at rounded corners of the quadrilateral body, the notch adjoining the cut-out at a bottom of the quadrilateral body, a first pair of strengthening strips disposed along the length sides of the quadrilateral body, each of the first pair of strengthening strips comprises a layer stack having a first layer of silicon carbide disposed over the quadrilateral body, a second layer of titanium nitride disposed on the first layer, a third layer of aluminum nitride disposed on the second layer, and a fourth layer of boron carbide disposed on the third layer, and a second pair of strengthening strips disposed along the width sides of the quadrilateral body, each of the second pair of strengthening strips comprises a first layer stack having a first layer of titanium nitride disposed over the quadrilateral body, a second layer of titanium carbide disposed on the first layer, and a third layer of graphite disposed on the second layer.

In another implementation, the main header includes a quadrilateral body having two parallel length sides, two parallel width sides, and four rounded corners joining the length sides to the width sides, a flange extended around and upwardly from an outer periphery of the quadrilateral body, a strip-like cut-out formed in the flange at four rounded corners of the quadrilateral body, a notch disposed at four rounded corners of the quadrilateral body, the notch adjoining the cut-out at a bottom of the quadrilateral body, a first pair of strengthening strips disposed adjacent to the notch along a longitudinal direction of the strip-like cut-out, each of the first pair of strengthening strips comprises a layer stack having a first layer of titanium nitride and a second layer disposed on the quadrilateral body and a second layer of titanium carbide disposed on the first layer, and a third layer of graphite disposed on the second layer, and a second pair of strengthening strips disposed radially external to the first pair of strengthening strips and oriented along the longitudinal direction of the strip-like cut-out, each of the second pair of strengthening strips comprises a layer stack having a first layer of titanium nitride and a second layer of titanium carbide that are alternatingly arranged over the quadrilateral body, and a third layer of graphite disposed on the alternatingly arranged first layer and second layer and in physical contact with the second layer.

In yet another implementation a body having a rectangular shape, a plurality of holes formed through the body, the holes being oriented to a direction that is perpendicular to a longitudinal direction of the body, a plurality of trenches alternatingly arranged with the holes, each trench having a length greater than a length of the holes, a flange extending upwardly from an outer periphery of the body, the flange surrounding the holes and the trenches, a cut-out formed in the flange at four corners of the body, a notch disposed at four corners of the body, the notch adjoining the cut-out at a bottom of the body, a first pair of strengthening strips disposed at length sides of the body, each of the first pair of strengthening strips comprises silicon carbide, titanium nitride, aluminum nitride, boron carbide, or graphite, or any combination thereof, and a second pair of strengthening strips disposed adjacent to the notch along a longitudinal direction of the cut-out, each of the first pair of strengthening strips comprises a layer stack having a first layer of titanium nitride and a second layer disposed over the body and a second layer of titanium carbide disposed on the first layer, and a third layer of graphite disposed on the second layer.

BRIEF DESCRIPTION OF THE DRAWINGS

So that the manner in which the above-recited features of the present disclosure can be understood in detail, a more particular description of the implementations, briefly summarized above, may be had by reference to implementations, some of which are illustrated in the appended drawings. It is to be noted, however, that the appended drawings illustrate only typical implementations of this disclosure and are therefore not to be considered limiting of its scope, for the disclosure may admit to other equally effective implementations.

FIG. 4A illustrates a cross-sectional view of the main header before subjecting to a flanging process.

FIG. 4B illustrates a top view of the main header of FIG. 4A.

Figure 1A:
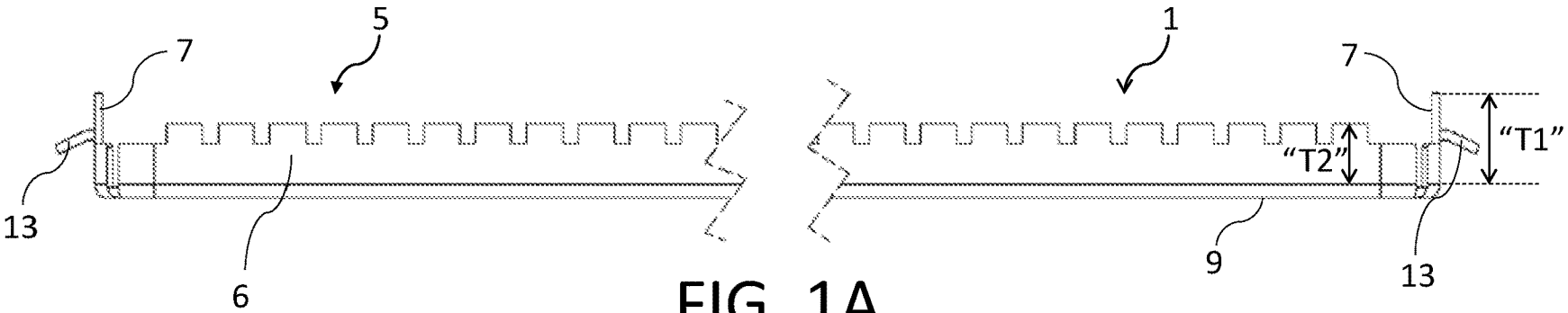
FIG. 1A illustrates a cross-sectional view of a main header according to embodiments of the present disclosure.

To facilitate understanding, identical reference numerals have been used, where possible, to designate identical elements that are common to the figures. It is contemplated that elements and features of one implementation may be beneficially incorporated in other implementations without further recitation. It is to be noted, however, that the appended drawings illustrate only exemplary implementations of this disclosure and are therefore not to be considered limiting of its scope, for the disclosure may admit to other equally effective implementations.

DETAILED DESCRIPTION

The following disclosure describes an improved main header for the internal combustion engine radiator. Details are set forth in the following description and in FIGS. 1A-9 to provide a thorough understanding of various implementations of the disclosure. Many of the details, dimensions, angles and other features shown in the Figures are merely illustrative of particular implementations. Accordingly, other implementations can have other details, components, dimensions, angles and features without departing from the spirit or scope of the present disclosure. In addition, further implementations of the disclosure can be practiced without several of the details described below.

Figure 1B:
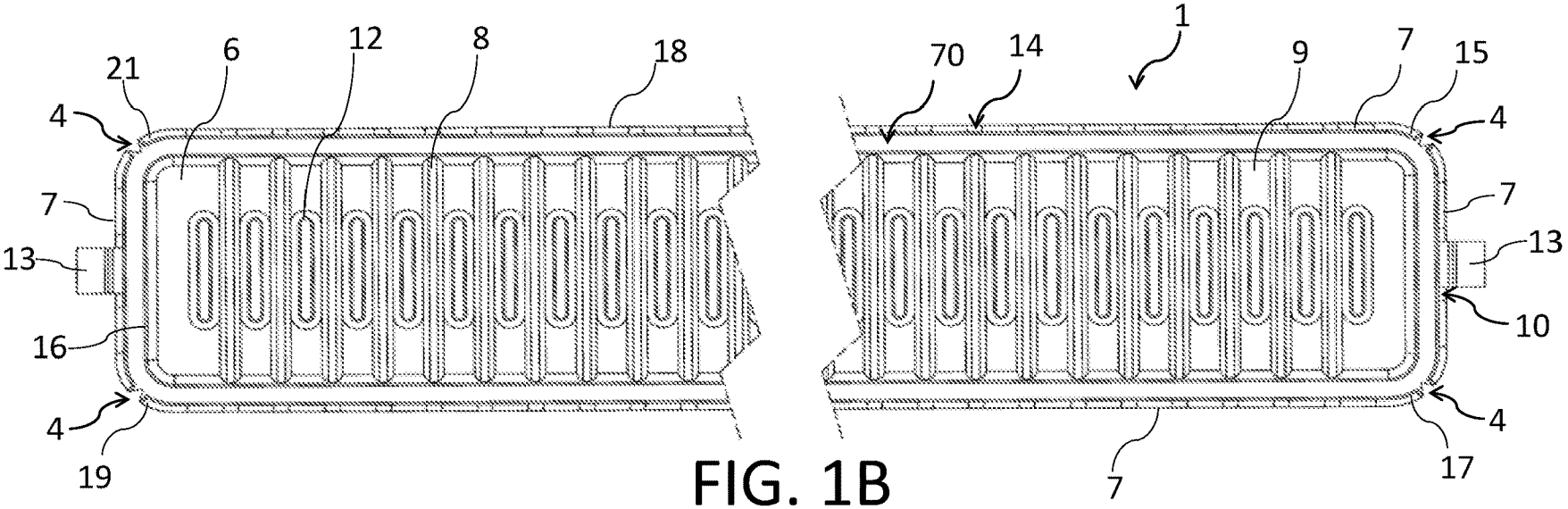
FIG. 1B illustrates a top view of the main header of FIG. 1A.
Figures 2, 3:
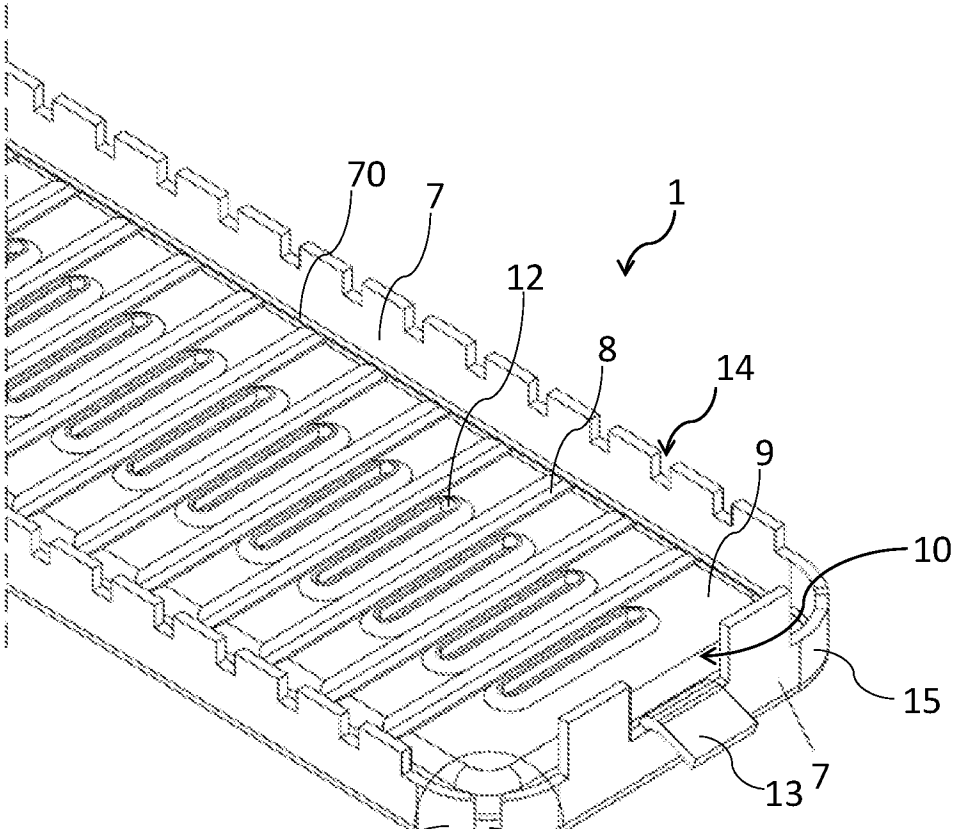
FIG. 2 illustrates a perspective view of a portion of the main header of FIG. 1B according to embodiments of the present disclosure.
FIG. 3 illustrates a perspective view of a portion of the main header of FIG. 2.
Figure 3:
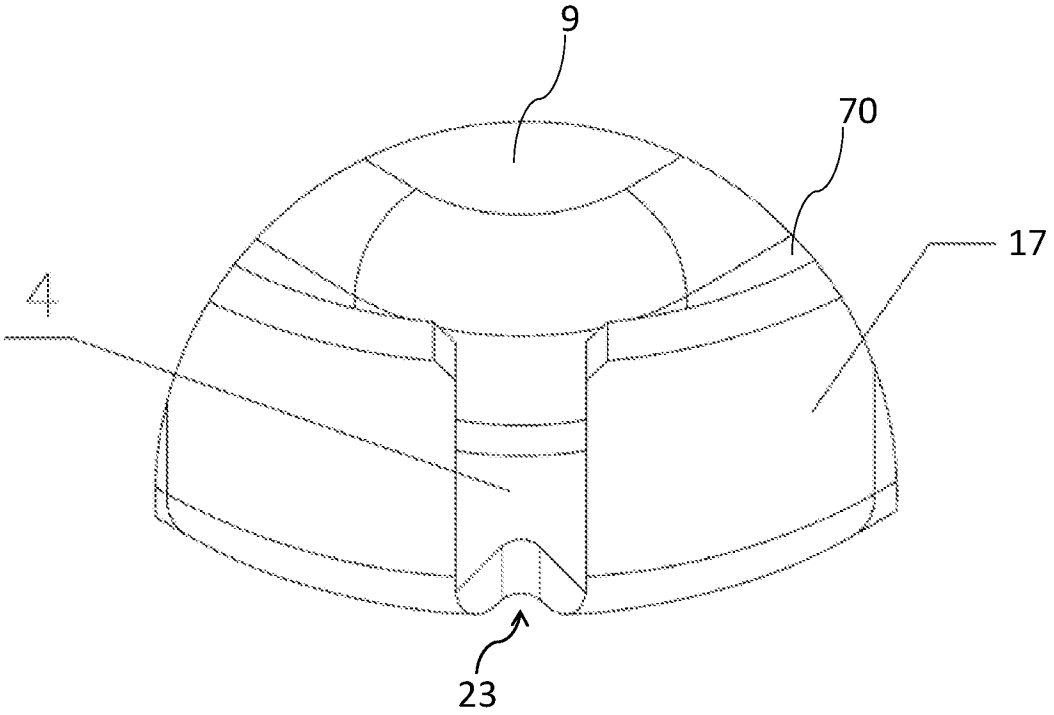

FIG. 1A illustrates a cross-sectional view of a main header 1 according to embodiments of the present disclosure. FIG. 1B illustrates a top view of the main header 1 of FIG. 1A. FIG. 2 illustrates a perspective view of a portion of the main header 1 of FIG. 1B. Referring to FIGS. 1A and 1B, the main header 1 is a plate body 6 of a quadrilateral having two parallel length sides and two parallel width sides. In one embodiment, the plate body 6 has a rectangular shape. The plate body 6 may have a thickness of about 1.5 mm to about 3 mm. The plate body 6 is formed from aluminum, aluminum alloy, or the like.

The main header 1 has a plurality of mounting holes 12 formed through the plate body 6. The mounting holes 12 can be formed by any suitable process such as drilling, stretching or puncturing. The mounting holes 12 are identical in size and parallel to one another. The mounting holes 12 are oriented to a direction that is perpendicular to the longitudinal direction of the plate body 6.

The main header 1 also has a plurality of trenches 8 alternatingly arranged with the mounting holes 12. The trenches 8 are identical in size and parallel to the mounting holes 12. The trenches 8 have a length that is greater than that of the holes 12. The trenches 8 may or may not extend through the thickness of the plate body 6. The mounting holes 12 and the trenches 8 are located within an inner periphery 16 that goes around the plate body 6. The inner periphery 16 is about 5 mm to about 60 mm away from an outer periphery 18 of the main header 1.

In one embodiment, which can be combined with any other embodiments disclosed in this disclosure, the bottom region between the inner periphery 16 and the outer periphery 18 is coated with a quartz layer 70. In one embodiment, the quartz layer 70 is a flamed polished quartz. In another embodiment, the quartz layer 70 is a synthetic quartz. In yet another embodiment, the quartz layer 70 is a fluorine-doped fused quartz or silica.

The main header 1 has a flange 7 extending upwardly from the edge of the plate body 6. The flange 7 is at an angle of about 90° with respect to the bottom 9 of the main header 1. The flange 7 goes around the outer periphery 18 of the plate body 6, defining a closed half cavity 5 therein for the main header 1. The flange 7 at the width sides of the main header 1 has a first height "T1" and the flange 7 at the length sides of the main header 1 has a second height "T2" that is less than the first height "T1". The flange 7 may be formed by any suitable metal processes such as flanging, stamping, pressing, blanking, drawing, bending, punching, or any combination thereof.

The main header 1 has a first U-shaped groove 10 formed in the flange 7 on the width sides of the main header 1. The main header 1 also has a plurality of second U-shaped grooves 14 formed in the flange 7 on the length sides of the main header 1. The second U-shaped grooves 14 are identical in size and equally spaced along the length of the main header 1. In one embodiment, the first U-shaped groove 10 is wider and deeper than the second U-shaped grooves 14. The main header 1 also has an extension 13 extending outwardly from the flange 7 at the width sides of the main header 1. In some embodiments, the extensions 13 are pointed downwardly and form an angle of about 20° to about 60° with respect to the flange 7 of the main header 1.

In some embodiments, the flange 7 at the corners of the main header 1 has a rounded shape. The flange 7 at the width sides and the flange 7 at the length sides are joined at rounded corners 15, 17, 19, and 21. That is, the main header 1 has four rounded corners 15, 17, 19, and 21. Particularly, each of the rounded corners 15, 17, 19, and 21 is provided with a cut-out 4. The cut-outs 4 may have a strip-shaped extending vertically through the flange 7, as shown in FIG. 2. In one aspect, the cut-outs 4 have a width of about 2 mm to about 5 mm, such as about 3 mm.

In some embodiments, which can be combined with any other embodiments of the present disclosure, the main header 1 has a notch 23 disposed at the rounded corners 15, 17, 19, and 21. The cut-outs 4 and the notches 23 are provided to release a stress concentrated at rounded corners 15, 17, 19, and 21 after the main header 1 is flanged. The notch 23 may have a V-shape, a U-shape, or the like. The notch 23 may be formed at the bottom 9 of the main header 1 where the cut-outs 4 are located. That is, the notches 23 and the cut-outs 4 are adjoined at the bottom 9 of the main header 1 (or plate body 6). FIG. 3 illustrates a perspective view of a portion of the main header 1 of FIG. 2 showing a V-shaped notch 23 with its opening facing outward and adjoining to the cut-out 4.

FIG. 4A illustrates a cross-sectional view of the main header 1 before subjecting to a flanging process. FIG. 4B illustrates a top view of the main header 1 of FIG. 4A. The main header 1 may be subjected to one or more metal processes, such as a blanking process or any suitable cutting process or trimming process, to form the cut-outs 4, the V-shaped notches 23, and the first and second U-shaped grooves 10, 14 at the same time. The cut-outs 4 and the V-shaped notches 23 at four corners 15, 17, 19, 21 of the main header 1 are completely identical. The main header 1 is then subjected to a flanging process which bends the edge of the plate body 6 by about 90° to form the flange 7 and the unstressed main header structure, as shown in FIGS. 1A-1B and 2.

The introduction of the cut-outs 4 and the V-shaped notches 23 allows the stresses to be released at the four corners after the main header 1 is flanged. Since the stresses are not concentrated, the main header 1 can be maintained straight after the flanging process and the subsequent brazing process, thereby preventing the pressure mounting and radiator leakage due to bending of the main header that would have otherwise occurred if no cut-outs 4 and V-shaped notches 23 were provided to release the stresses.

Figure 5:
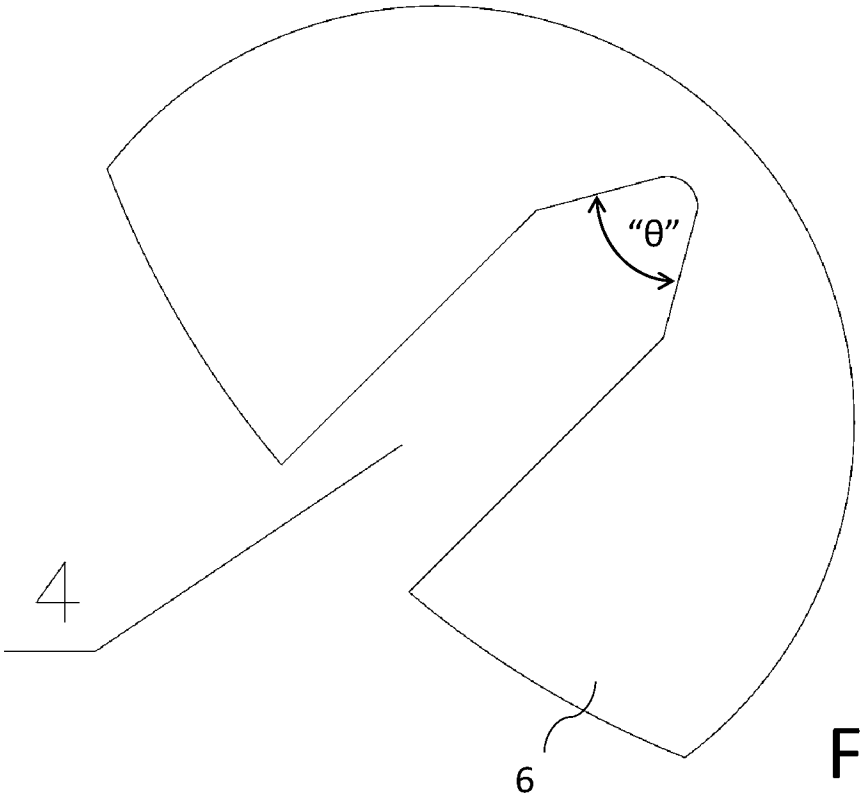
FIG. 5 is an enlarged view of a portion of the main header of FIG. 4B showing the cut-outs according to one embodiment of the present disclosure.

FIG. 5 is an enlarged view of a portion of the main header 1 of FIG. 4B showing the cut-outs 4 according to one embodiment of the present disclosure. In this embodiment, the cut-out 4 is extended from the edge of the plate body 6 and terminated by an acute-angled V-shaped notch 23. The V-shaped notch 23 has an apex angle "θ" of about 40° to about 80°, for example about 65°.

Figure 6:
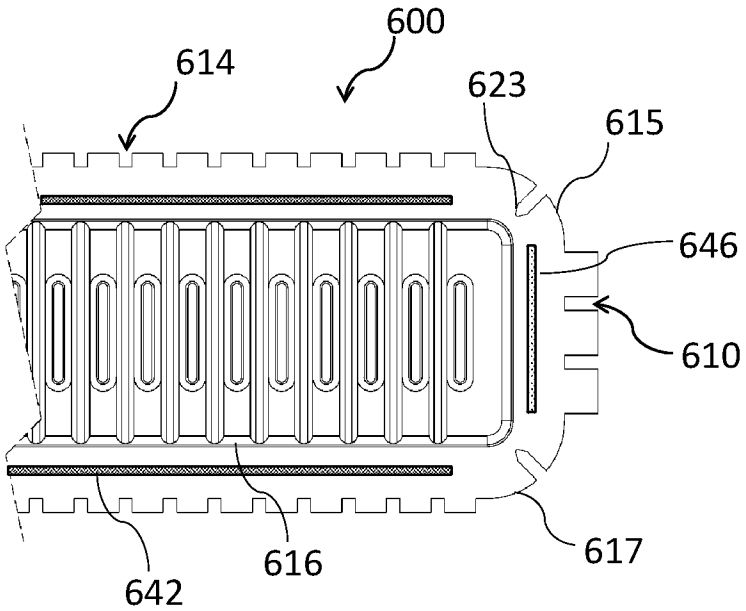
FIG. 6 illustrates a cross-sectional view of a main header before subjecting to a flanging process.

FIG. 6 illustrates a cross-sectional view of a main header 600 before subjecting to a flanging process. The main header 600 is similar to the main header 1 shown in FIGS. 1A and 1B in design. Likewise, the main header 600 has a plurality of mounting holes 612 formed through the plate body 606, which is formed from aluminum, aluminum alloy, or the like. The mounting holes 612 are parallel to one another and oriented to a direction that is perpendicular to the longitudinal direction of the main header 600. The main header 600 also has a plurality of trenches 608 alternatingly arranged with the mounting holes 612.

In one embodiment, which can be combined with any other embodiments disclosed in this disclosure, the bottom region between an inner periphery 616 and the outer periphery 618 may be optionally coated with a quartz layer 670. In one embodiment, the quartz layer 670 is a flamed polished quartz. In another embodiment, the quartz layer 670 is a synthetic quartz. In yet another embodiment, the quartz layer 670 is a fluorine-doped fused quartz or silica.

Similarly, the main header 600 has first and second U-shaped grooves 610, 614 disposed at the width sides and length sides of the main header 600, respectively. The main header 600 also has cut-outs 604 provided at the four corners 615, 617, 619, 621 of the main header 600. A first pair of strengthening strips 640, 642 is disposed on the plate body 606 (or the quartz layer 670, if used) along the length sides of the main header 600. The strengthening strips 640 and 642 are parallel and opposed to each other. A second pair of strengthening strips 644, 646 is disposed on the plate body 606 (or the quartz layer 670, if used) along the width sides of the main header 600.

The first pair of strengthening strips 640, 642 are formed from silicon carbide, titanium nitride, aluminum nitride, boron carbide, or graphite, or any combination thereof. In one embodiment shown in FIG. 7A, the first pair of strengthening strips 640, 642 are each constructed as a layer stack 702 having a first layer 750 of silicon carbide disposed on the plate body 606 (or the quartz layer 670, if used), a second layer 752 of titanium nitride disposed on the first layer 750, a third layer 754 of aluminum nitride disposed on the second layer 752, and a fourth layer 756 of boron carbide disposed on the third layer 654.

In some embodiments, which can be combined with any of the embodiments disclosed in this disclosure, the first layer 750 of silicon carbide is doped with scandium or lanthanum. In such a case, the dopant concentration can be in a range of about $10^{19}$ $cm^{-3}$ to about $10^{21}$ $cm^{-3}$.

In some embodiments, which can be combined with any of the embodiments disclosed in this disclosure, the first layer 750 of silicon carbide further includes 30 mol. % of scandium, 15 mol. % of nickel and 25 mol. % of platinum, with the rest being silicon carbide.

In some embodiments, which can be combined with any of the embodiments disclosed in this disclosure, the third layer 754 of aluminum nitride has Mg-doped ZnO nanoparticles 755 distributed within the third layer 754 of aluminum nitride. In such a case, the nanoparticles 755 can be less than 100 nm in size, for example about 50 nm to 80 nm in size.

Figure 7C:
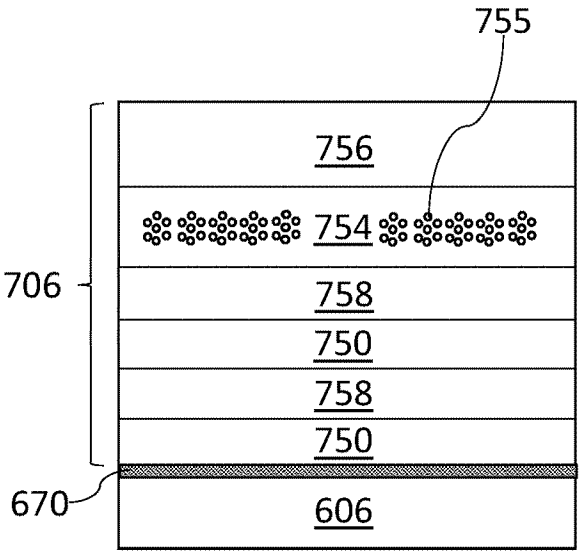
FIGS. 7A-7C illustrate an exemplary layer structure of a first pair of strengthening strips according to embodiments of the present disclosure.
Figure 7B:
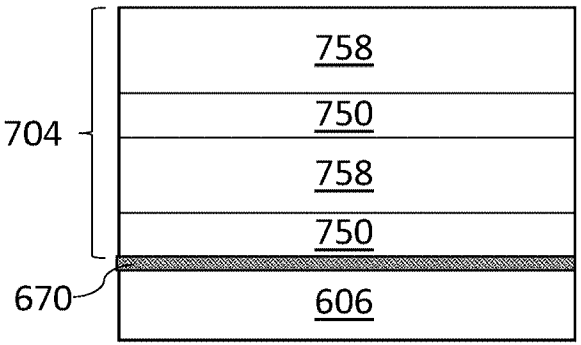

In another embodiment shown in FIG. 7B, the first pair of strengthening strips 640, 642 are each constructed as a layer stack 704 having a first layer 750 of silicon carbide and a second layer 758 of graphite alternatingly arranged over the plate body 606 (or the quartz layer 670, if used). In one aspect, the first layer 750 of silicon carbide has a first thickness T1 and the second layer 758 of graphite has a second thickness T2 that is greater than the first thickness T1. The layer stack 704 may repeat as needed (e.g., 2-3 times) until a desired thickness is reached. In one example, the layer stack 704 may have a thickness of about 5 mm to about 30 mm.

In yet another embodiment shown in FIG. 7C, the first pair of strengthening strips 640, 642 are each constructed as a layer stack 706 having a first layer 750 of silicon carbide and a second layer 758 of graphite that are alternatingly arranged over the plate body 606 (or the quartz layer 670, if used). The alternation of the first and second layer 750, 758 may repeat as needed (e.g., 2-3 times) until a desired thickness (e.g., about 15 mm to about 40 mm) is reached. A third layer 754 of aluminum nitride is disposed on the alternatingly arranged first layer 750 and second layer 758 and in physical contact with the second layer 758. A fourth layer 756 is then disposed on the third layer 754.

Figure 7A:
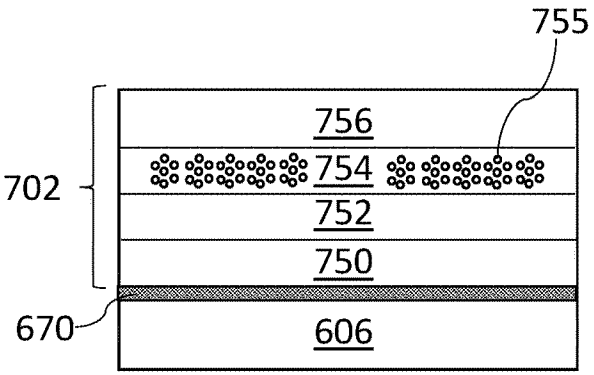

In any of the embodiments described in FIGS. 7A-7C, the first pair of strengthening strips 640, 642 are each have a cross section having a square, circle, or trapezoid. In one example, the first pair of strengthening strips 640, 642 are each have a cross section of trapezoid.

The second pair of strengthening strips 644, 646 are formed from titanium nitride, titanium carbide, graphite, or a combination thereof. In one embodiment shown in FIG. 8A, the second pair of strengthening strips 644, 646 are each constructed as a layer stack 802 having a first layer 850 of titanium nitride disposed on the plate body 606 (or the quartz layer 670, if used), a second layer 852 of titanium carbide disposed on the first layer 850, and a third layer 854 of graphite disposed on the second layer 852.

In some embodiments, which can be combined with any of the embodiments disclosed in this disclosure, the second layer 852 of titanium carbide has nanoparticles of aluminum oxide 853 distributed therein. In such a case, the nanoparticles can be less than 100 nm in size, for example about 50 nm to 80 nm in size. Alternatively, the second layer 852 of titanium carbide can be replaced with a metal form layer, such as a layer of ceramic foam matrices In another embodiment shown in FIG. 8B, the second pair of strengthening strips 644, 646 are each constructed as a layer stack 804 having a first layer 850 of titanium nitride and a second layer 852 of titanium carbide that are alternatingly arranged over the plate body 606 (or the quartz layer 670, if used). The alternation of the first and second layer 850, 852 may repeat as needed (e.g., 2-3 times) until a desired thickness (e.g., about 15 mm to about 40 mm) is reached. A third layer 854 of graphite is disposed on the alternatingly arranged first layer 850 and second layer 852 and in physical contact with the second layer 852.

In some embodiments, which can be combined with any of the embodiments disclosed in this disclosure, the first layer 850 of titanium nitride further includes 40 mol. % of lanthanum, 5 mol. % of nickel and 30 mol. % of platinum, with the rest being titanium nitride, and the second layer 852 of titanium carbide further includes 30 mol. % of scandium, 5 mol. % of nickel and 30 mol. % of platinum, with the rest being titanium carbide.

In some embodiments, each of the first pair of strengthening strips 640, 642 may be constructed as a layer stack 702 and each of the second pair of strengthening strips 644, 646 may be constructed as a layer stack 704 as discussed above with respect to FIG. 7B.

In some embodiments, each of the first pair of strengthening strips 640, 642 may be constructed as a layer stack 702 and each of the second pair of strengthening strips 644, 646 may be constructed as a layer stack 706 as discussed above with respect to FIG. 7C.

In some embodiments, each of the first pair of strengthening strips 640, 642 may be constructed as a layer stack 802 as discussed above with respect to FIG. 8A, and each of the second pair of strengthening strips 644, 646 may be constructed as a layer stack 804 as discussed above with respect to FIGS. 8B.

Figure 8B:
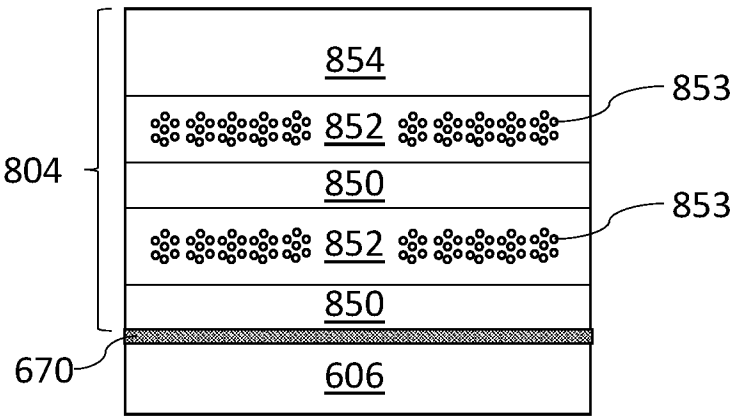
FIGS. 8A-8B illustrate an exemplary layer structure of a second pair of strengthening strips according to embodiments of the present disclosure.
Figure 8A:
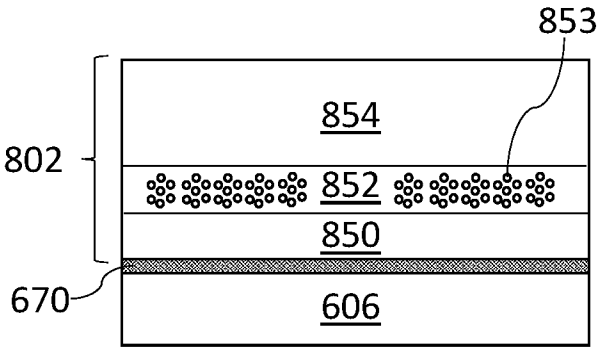
Figure 9:
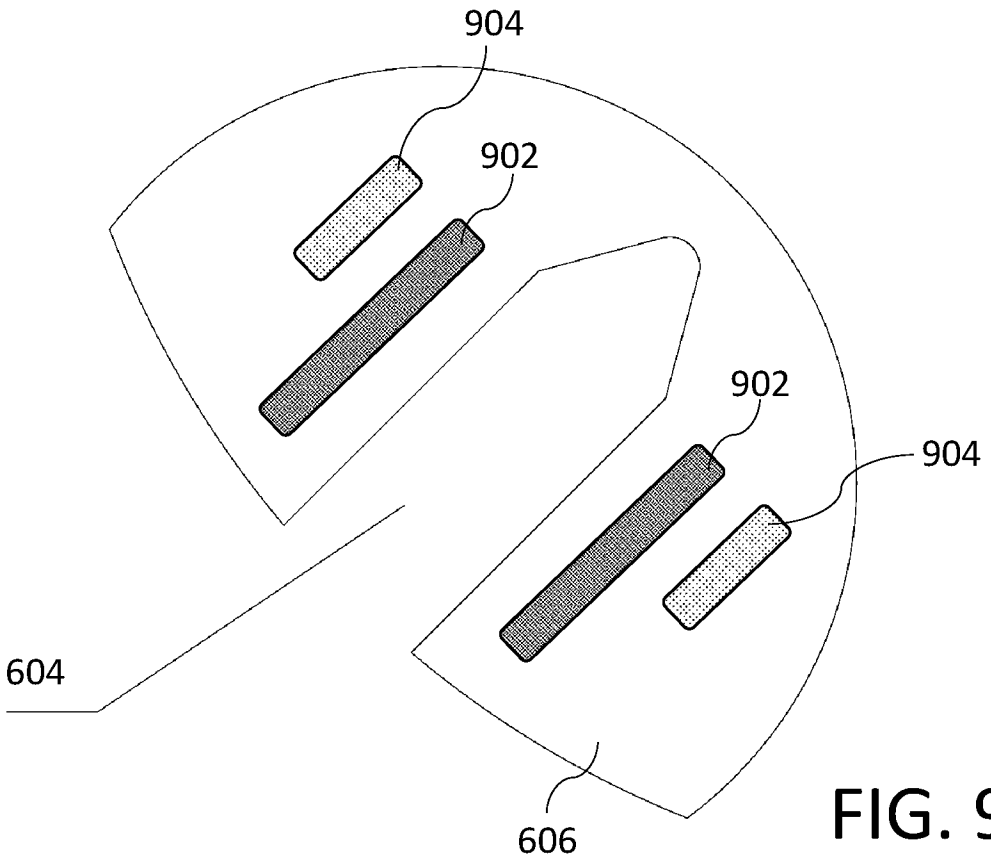

In any of the embodiments described in FIGS. 8A-8B, the second pair of strengthening strips 644, 646 are each have a cross section having a square, semi-circle, or trapezoid. In one exemplary embodiment, the first pair of strengthening strips 640, 642 are each have a cross section of trapezoid and the second pair of strengthening strips 644, 646 are each have a cross section of semi-circle, or vice versa.

Figure 9:
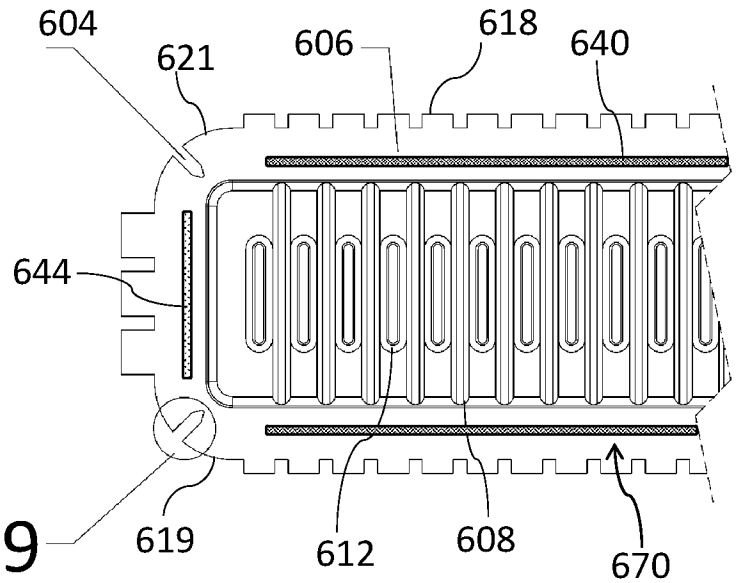
FIG. 9 illustrates a perspective view of a portion of the main header of FIG. 6 according to another embodiment of the present disclosure.

FIG. 9 illustrates a perspective view of a portion of the main header 600 of FIG. 6 according to another embodiment of the present disclosure. In this embodiment, which may be combined with any of the embodiments disclosed in this disclosure, a first pair of strengthening strips 902 are disposed on the plate body 606 adjacent to the cut-outs 604. The first pair of strengthening strips 902 may be formed from the same material as the first pair of strengthening strips 640, 642 as discussed above. A second pair of strengthening strips 904 are disposed radially external to the first pair of strengthening strips 902. That is, the first pair of strengthening strips 902 is sandwiched between the cut-out 604 and the second pair of strengthening strips 904. The second strengthening strips 904 may be formed from the same material as the second pair of strengthening strips 644, 646 as discussed above.

The first pair of strengthening strips 902 has a first length "T3" and the second pair of strengthening strips 904 has a second length "T4" that is greater than the first length "T3". In any case, the first pair of strengthening strips 902 and the second pair of strengthening strips 904 are parallel to each other and oriented along the longitudinal direction of the cut-outs 604.

In some embodiments, each of the first pair of strengthening strips 902 may be constructed as a layer stack 702 and each of the second pair of strengthening strips 904 may be constructed as a layer stack 706.

In some embodiments, each of the first pair of strengthening strips 902 may be constructed as a layer stack 802 and each of the second pair of strengthening strips 904 may be constructed as a layer stack 804.

Embodiments of the present disclosure provide an improved main header for internal combustion engine radiator. The inventive main header has cut-outs and V-shaped notches provided at the four corners of the main header to release the stresses after the main header is flanged, thereby ensuring the flatness or straightness of the main header. The inventive main header further includes one or more strengthening strips disposed along the length sides and the width sides of the main header, and optionally at the region adjacent to the cut-outs, to further enhance the flatness of the main header. As a result, the main header after the subsequent brazing process can still maintain good compression with the seal ring and avoid radiator leakage due to the bending of the main header, as would otherwise occur in a conventional main header if no such notches or strengthening strips were provided to release the stresses.

While the foregoing is directed to implementations of the present disclosure, other and further implementation of the disclosure may be devised without departing from the basic scope thereof, and the scope thereof is determined by the claims that follow.

The invention claimed is:

1. A main header for an internal combustion engine radiator, comprising:

a quadrilateral body having two parallel length sides, two parallel width sides, and four rounded corners joining the length sides to the width sides;

a flange extended around and upwardly from an outer periphery of the quadrilateral body;

a strip-like cut-out formed in the flange at four rounded corners of the quadrilateral body;

a notch disposed at four rounded corners of the quadrilateral body, the notch adjoining the cut-out at a bottom of the quadrilateral body;

a first pair of strengthening strips disposed adjacent to the notch along a longitudinal direction of the strip-like cut-out, each of the first pair of strengthening strips comprises a layer stack having a first layer of titanium nitride and a second layer disposed on the quadrilateral body and a second layer of titanium carbide disposed on the first layer, and a third layer of graphite disposed on the second layer; and a second pair of strengthening strips disposed radially external to the first pair of strengthening strips and oriented along the longitudinal direction of the strip-like cut-out, each of the second pair of strengthening strips comprises a layer stack having a first layer of titanium nitride and a second layer of titanium carbide that are alternatingly arranged over the quadrilateral body, and a third layer of graphite disposed on the alternatingly arranged first layer and second layer and in physical contact with the second layer.

2. The main header of claim 1, wherein the second layer of titanium carbide has nanoparticles of aluminum oxide distributed therein.

3. The main header of claim 1, wherein the notch is a V-shaped notch with its opening facing outward and adjoining to the cut-out.

4. The main header of claim 1, further comprising:

a plurality of mounting holes formed through the quadrilateral body, the mounting holes being parallel to one another and oriented to a direction that is perpendicular to a longitudinal direction of the quadrilateral body; and a plurality of trenches formed through the quadrilateral body, the trenches being alternatingly arranged with the mounting holes and having a length greater than a length of the mounting holes.

5. The main header of claim 1, further comprising:

a first U-shaped groove formed in the flange on the width sides of the quadrilateral body; and a plurality of second U-shaped grooves formed in the flange on the length sides of the quadrilateral body.

6. The main header of claim 1, wherein the notch is a V-shaped notch, a U-shaped notch, or the like.

* * * * *